United States Patent [19]

Marsilio et al.

[11] 4,128,745

[45] Dec. 5, 1978

[54] SLIDE SWITCH WITH SNAP-ACTION DETENT MEANS

[75] Inventors: Dominic O. Marsilio, Flourtown; Edwin J. O'Bryan, Philadelphia, both of Pa.

[73] Assignee: Continental-Wirt Electronics Corporation, Warminster, Pa.

[21] Appl. No.: 756,689

[22] Filed: Jan. 4, 1977

[51] Int. Cl.[2] ..... H01H 15/18; H01H 9/00

[52] U.S. Cl. ..... 200/16 C; 200/16 R; 200/291; 74/527

[58] Field of Search ..... 74/527; 200/16 C, 16 D, 200/237, 153 K, 252, 291, 339

[56] References Cited

U.S. PATENT DOCUMENTS

| | | | |
|---|---|---|---|
| 2,413,135 | 12/1946 | Baumgardner | 200/16 C |
| 2,528,115 | 10/1950 | Clayton | 74/527 X |
| 3,173,306 | 3/1965 | Hoag | 74/527 |
| 3,174,002 | 3/1965 | Golbeck | 200/291 X |
| 3,196,237 | 7/1965 | Westgate | 200/291 X |
| 3,299,227 | 1/1967 | Schaad et al. | 200/16 C |
| 3,370,143 | 2/1968 | Barney | 74/527 X |
| 4,034,178 | 7/1977 | Koppenheffer et al. | 200/291 X |

FOREIGN PATENT DOCUMENTS

| | | | |
|---|---|---|---|
| 884009 | 7/1943 | France | 200/291 |
| 406353 | 8/1966 | Switzerland | 200/291 |

*Primary Examiner*—James R. Scott
*Attorney, Agent, or Firm*—Edelson and Udell

[57] ABSTRACT

A multiple-position slide switch having a detent member operative side-wise with respect to the path of movement of the sliding contact carrier of the switch to hold the carrier in a selected position. The detent member which is formed of material, preferably such as moldable plastic, having the power of recovering its initially produced durable or static shape when a deforming force or pressure causing it to be temporarily deformed is removed, is in the form of a flat member having a pair of laterally spaced longitudinally extending flexible struts which embrace therebetween an upwardly projecting knob of the slidable carrier, the inner edges of the struts and the outer surfaces of the carrier knob being complementally shaped to provide coacting surfaces which coact upon deflection of the struts to snap the carrier into its selected position. In one form of the invention, the detent member provides the snap-action movement through the intervention of a pivoted toggle lever acting upon the slidable contact carrier knob, while in another form thereof the snap-action is provided by direct manual manipulation of the slidable contact carrier knob.

11 Claims, 11 Drawing Figures

FIG. 1
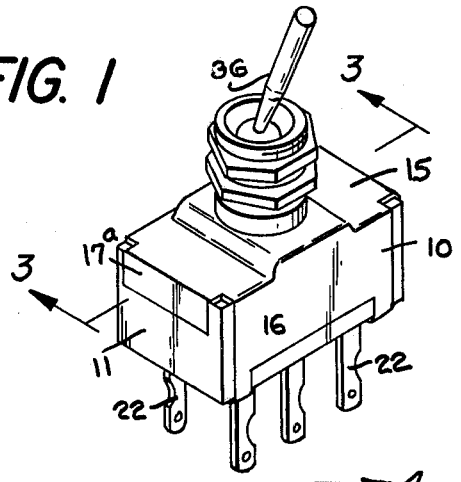
FIG. 3
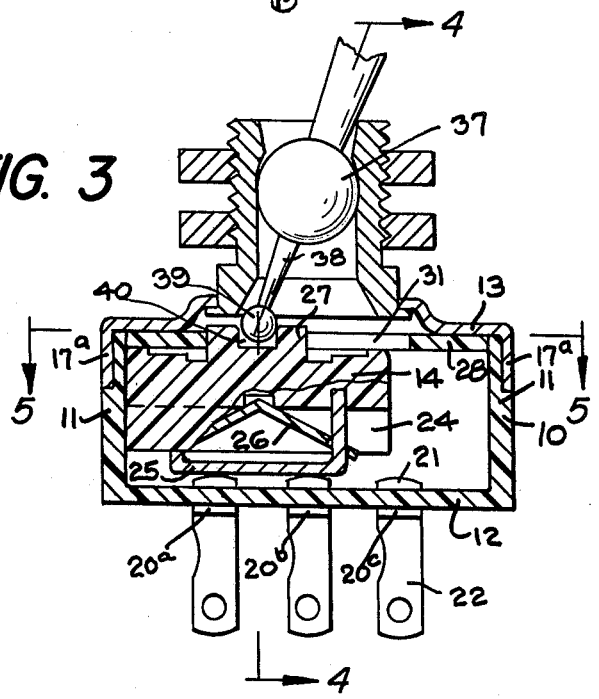
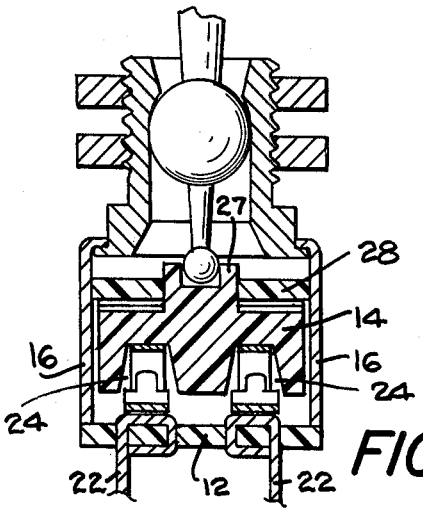
FIG. 4
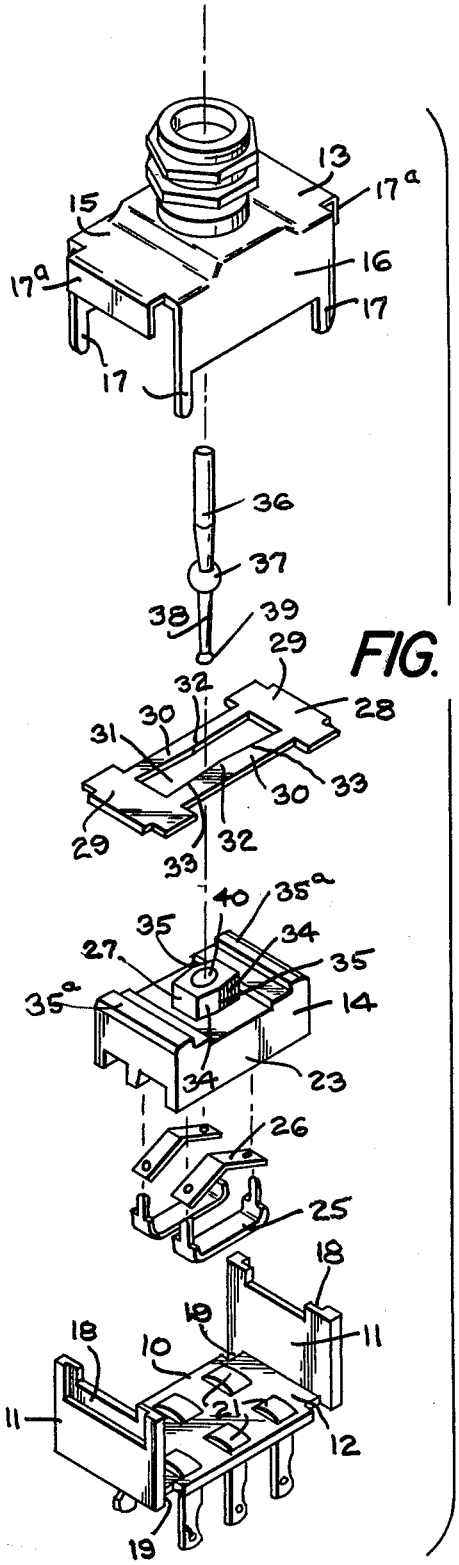
FIG. 2

FIG. 5
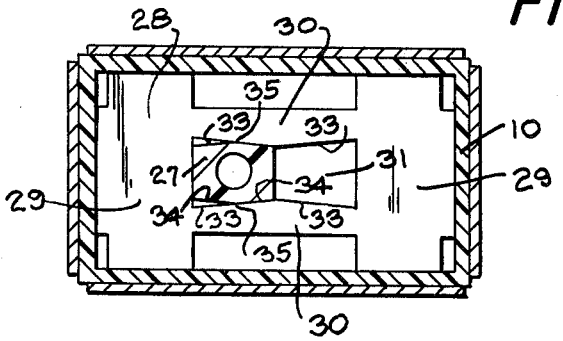
FIG. 6
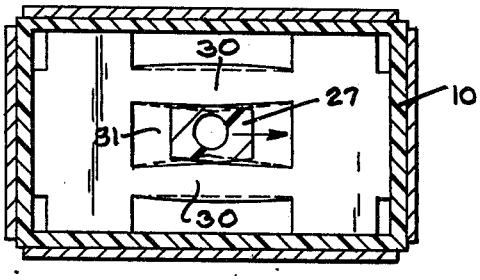
FIG. 11
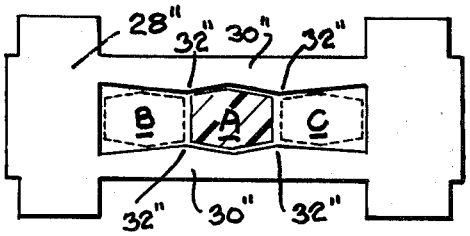
FIG. 7
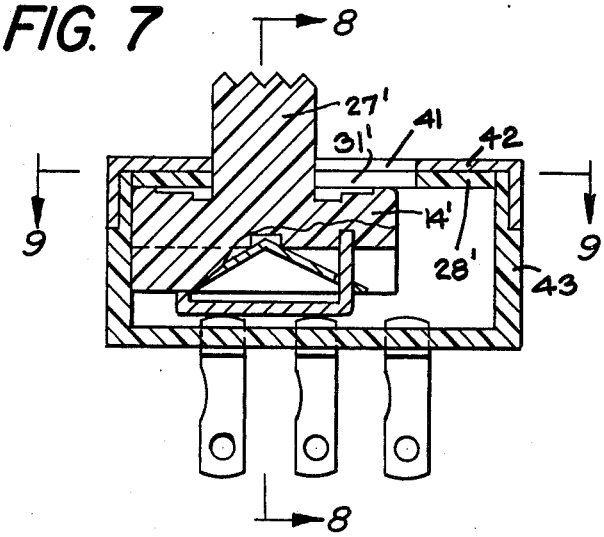
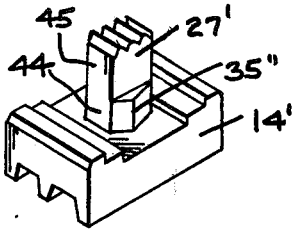
FIG. 10
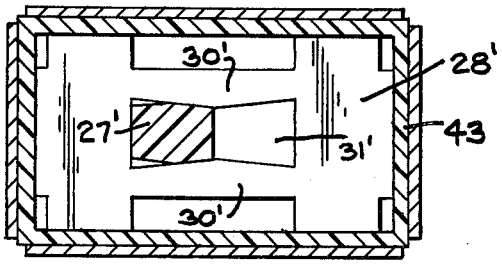
FIG. 9
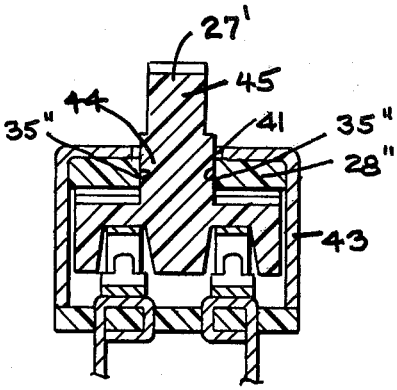
FIG. 8

SLIDE SWITCH WITH SNAP-ACTION DETENT MEANS

BACKGROUND OF THE INVENTION

This invention relates generally to electric slide switches and more particularly to an improved construction of a slide switch having detent means which not only holds the slidable member of the switch in a selected one of a plurality of different positions but also effects snap action operation of the switch into a positively held selected position.

Electric slide switches of the type to which the present invention relates are customarily provided with detent means for releasably holding the slidable contacts thereof in bridging relation to a selected pair of relatively fixed contacts. These previously known detent means, usually made of spring metal, are generally of two basic types, namely, those which move with the carrier for the slidable contacts and have projections which snap into apertures or recesses provided therefor in a fixed part of the switch housing, and those which are stationary and have projections which snap into apertures or recesses provided therefor in the slidable carrier itself. In all of these prior types of detent mechanisms, the vertical pressures exerted by the protrusions as they move into and out of their accomodating detaining recesses objectionally increases the contact pressure between the fixed and movable contact elements of the slide switch, as the result of which the contact surfaces become prematurely excessively worn. Also, since the detent protrusions are oriented orthogonally with respect to the plane of movement of the slidable contacts of the switch, the vertical dimension of the switch is necessarily increased in order to operatively accomodate the vertically extending detent protrusions.

Having in mind the foregoing, it is a principal object of the present invention to provide a detent member for a slide switch which is so relatively thin and flat that it may be included in the switch without materially increasing its bulk and particularly its vertical dimension.

Still another important object of the invention is to provide a detent member wherein the detenting action in respect to the slidable contacts of the switch is directed sidewise thereof in a flat plane which parallels the path of movement of said contacts.

A further and important object of the invention is to provide a detent formed of a material such as moldable plastic which has the elastical power of recovering its initially produced shape when a deforming force or load causing it to be temporarily deformed is removed.

Still another main object of the invention is to provide a slide switch with detent means which in and of itself automatically serves to effect a snap-action movement of the contact-carrying slide part of the switch without increasing the number of separate parts ordinarily present in slide switches having detents.

Other objects and advantages of the present invention will appear more fully hereinafter it being understood that the invention consists in the combination, construction, location and relative arrangement of parts, all as described in the following specification, as shown in the acompanying drawings and as finally pointed out in the appended claims.

BRIEF DESCRIPTION OF THE DRAWINGS

In the accompanying drawings:

FIG. 1 is a perspective view showing a toggle actuated slide switch constructed in accordance with and embodying the principles of the present invention;

FIG. 2 is an exploded view showing in perspective the several elements of the switch illustrated in FIG. 1;

FIG. 3 is a longitudinal vertical sectional view of the switch as taken along the line 3—3 of FIG. 1;

FIG. 4 is a transverse vertical sectional view of the switch as taken along the line 4—4 of FIG. 3 showing the switch actuator snapped into one of its detented end-most positions;

FIG. 5 is a horizontal sectional view as taken along the line 5—5 of FIG. 3;

FIG. 6 is a view similar to FIG. 5 showing the switch actuator in its unstable dead center position as it moves in the direction of the arrow from its endmost position shown in FIG. 5 to its opposite endmost position;

FIG. 7 is a longitudinal sectional view similar to FIG. 3 but showing a modified form of slide switch employing the snap-acting detent of the present invention;

FIG. 8 is a transverse sectional view as taken along the line 8—8 of FIG. 7;

FIG. 9 is a horizontal sectional view as taken along the line 9—9 of FIG. 7;

FIG. 10 is a perspective view of the modified knob type slidable contact carrier of the switch shown in FIG. 7; and FIG. 11 is a plan view of a modified form of the detent for use in a three-position switch showing in association therewith the operating knob of the switch in a centered position from which it can be oppositely shifted into either one of two endmost positions.

BRIEF DESCRIPTION OF THE PREFERRED EMBODIMENTS

Referring now more particularly to the drawings, it will be noted that while the present invention is shown as being embodied in a slide switch of the basic construction shown in U.S. Pat. No. 3,271,535, it will be understood that the principles of the invention are equally applicable to other constructions of slide switches which basically include a rectilinearly slidable switch actuator having movable therewith electrical contact members which are adapted to electrically bridge one or more sets of paired relatively fixed contact terminals upon movement of the switch actuator and the contact members carried thereby relatively to the fixed contact terminals.

FIGS. 1 to 6 inclusive illustrate the application of the present invention to a toggle actuated double-pole two-position slide switch which includes an insulating housing member 10 having opposed upstanding end walls 11—11 and a bottom wall 12 extending therebetween, which housing member 10 has interfitted therewith a top closure member 13, which may be of metal, to provide an enclosure for a rectilinearly shiftable contact carrier 14 disposed interiorly of the assembled housing. The top closure member 13, which is provided with a top wall 15 for disposition in vertically spaced substantially parallel relation to the bottom wall 12 of the insulating member 10, is additionally provided with depending side walls 16—16 which respectively fit between the end walls 11—11 of the insulating member 10 to complete the enclosure for the shiftable contact carrier 14. The depending side walls 16—16 are respectively provided with depending tabs 17—17 which are inturned about the undersurface of the insulating member 10 to securely lock together in assembled relation the two housing members 10 and 13.

Preferably, the top closure member 13 is provided with downturned ends $17^a$—$17^a$ which are flush-fitted in accommodating recesses 18—18 formed in the upper edge portions of the end walls 11 of the housing member 10, and similarly the securing tabs 17—17 of the member 13 are flush-fitted in notches 19—19 provided therefor in the bottom wall of the member 10.

This last-mentioned bottom wall 12 of the insulating housing member 10 serves as the insulating base member or terminal board having fixed thereon a single row or two or more parallel rows of longitudinally spaced contact elements $20^a$, $20^b$ and $20^c$. In the construction shown, this terminal board is provided with two parallel rows of these fixed contact elements, thus providing for a two-pole, two-position switch, but it will be apparent that the disposition and number of rows of such fixed contacts may be changed depending upon the number of poles and positions desired for any particular switch. These contact elements $20^a$, $20^b$ and $20^c$ are each staked to the base wall 12 of the switch housing to provide the same with an internally exposed contact head 21 and an externally exposed contact head 21 and an externally projecting terminal extension 22.

Disposed in the housing between the top wall 15 thereof and its insulating bottom wall 12 is the aforementioned rectilinearly shiftable contact carrier 14 having a rectangularly-shaped body portion 23 formed of a suitable dielectric material which is provided in its bottom surface with one or more longitudinally extending parallel channels 24 in each of which is suitably mounted for rectilinear shifting movement with the carrier 14 a metal contact shoe 25 of a length sufficient to electrically bridge an adjacent pair of the fixed contact elements $20^a$, $20^b$ and $20^c$ longitudinally alined in a row underlying the path of movement of a contact shoe 25. Each contact shoe is resiliently biased downwardly from its accomodating channel 24 in the slidable contact carrier 14 by any suitable means for effecting adequately pressured electrical engagement of the shoe with its underlying fixed contacts insulatingly secured to the bottom wall 12 of the switch housing. Preferably, this spring-pressed bias of the contact shoes is effected by a bowed spring element 26 interposed between each shoe and the base wall of the channel 24 in which it is accomodated, as described in the aforementioned U.S. Pat. No. 3,271,535.

It will be observed that the shiftable contact carrier 14, which is guided for rectilinear movement from one to the other of the switch housing by the housing side walls, is centrally provided on its top side with an upstanding integrally formed knob 27 which rides within a slotted detent member 28 interposed between the top wall 15 of the housing and the top surface of the shiftable contact carrier 14 enclosed within the housing. This slotted detent member 28, of the shape best shown in FIG. 2, is formed of any substantially rigid insulation material, such as nylon or other moldable thermosetting or thermoplastic plastic material having the elastical property of being able to immediately recover its initially molded durable shape when it is relieved of a deforming force or pressure causing it to be temporarily deformed.

Upon further reference to the detent member 28 as shown in FIG. 2, it will be observed that it consists of a relatively thin element of generally rectangular shape having coplanar opposite end portions 29—29 interconnected by a pair of longitudinally extending coplanar struts 30—30 laterally spaced apart to provide therebetween an elongated slot 31 which is designed to receive therein the upwardly projecting knob 27 of the shiftable contact carrier 14. The outer edges of the longitudinally extending struts 30—30 of this detent member are each spaced inwardly of the corresponding side edges of the contact carrier 14 and of the side walls of the housing in which the carrier 14 is slidable to thereby allow a restrained degree of outward flexure of the struts 30—30 upon the application of a flexing force to the inner edges thereof tending to oppositely bow the same from their relaxed dotted line positions into their full line positions as shown in FIG. 6.

It will be noted while the outer edges of the struts 30—30 in their relaxed condition are relatively straight and parallel to one another, the inner edges thereof, which define therebetween the elongated slot 31 for accomodation of the contact carrier knob 27, are each inwardly tapered from their opposite ends to a central point 32 to provide a pair of angularly related inner straightedged cam portions 33—33.

Also, it will be noted that the upwardly projecting knob 27 of the slidable contact carrier 14 is of a hexagonal shape in horizontal section to provide each of its opposite sides with correspondingly tapered surfaces 34—34 which are so angularly related as to conjointly form a centrally disposed vertically extending ridge 35 on each side of the knob. The overall width of the knob 27 as measured in the transversely extending plane of the knob side ridges 35—35 is sufficiently greater than the crosswise distance between the opposed central points 32—32 of the detent member struts 30—30 when the latter are in their relaxed, i.e., unstressed, condition as shown in FIGS. 2 and 5, as to cause the struts to flex outwardly from and then spring back into their said relaxed position as the knob of the carrier moves in one direction or the other from an end of the detent slot, (as see FIG. 5) past its position shown in FIG. 6 wherein the side ridges 35—35 of the knob are respectively in exact registry with the opposite points 32—32 of the detent plate slot 31.

In order to decrease the frictional resistance to movement of the contact carrier 14 relatively to the detent member 28 which is fixedly positioned immediately beneath the top wall of the switch housing, the said carrier is preferably undercut in its upper surface to provide a pair of upstanding end ribs $35^a$—$35^a$ which extend cross-wise of and constitute the sole surfaces which bear against the undersurface of the detent member.

For effecting the requisite rectilinear shifting of the slidable contact carrier 14, the top closure member 13 of the switch housing is provided with a toggle arm or lever 36 which is journalled as at 37 within a suitable supporting structure secured to and extending upwardly from the top wall of the member 13. This toggle lever is provided with a depending spindle 38 terminating in a ball-shaped extremity 39 which reaches into and is rockably seated in a circular socket 40 centrally formed in the top surface of the slidable carrier knob 27.

In operation of the toggle actuated slide switch of the construction above described, it will be apparent that as the toggle lever 36 is shifted from one to the other of its two positions, it causes the slidable contact carrier 14 to shift relatively to the detent member 28 with the knob 27 of the carrier moving in the detent slot 31 past its unstable dead center position shown in FIG. 6. In this dead center position of the slidable carrier knob 27, the detent struts 30—30 are maximally deformed into their full line positions shown in FIG. 6 by the pressures respectively exerted on them by the oppositely presenting ridges 35—35 of the switch slide knob 27. This deformation of the detent struts 30—30 results in the storing up of energy which serves when the carrier knob passes beyond its dead center position to snap the slidable contact-carrier of the switch to one side or the other of its said centered position by the camming action of a tapered edge 33 of the detent plate slot 31 on a correspondingly tapered side surface of the carrier knob 27. The velocity of travel of the slidable contact carrier 14 once it has passed over its dead center is not affected by any continued movement of the toggle lever 36 but instead is determined solely by the strength of the energy force which is generated by the inherent power of the flexed struts 30—30 of the detent member within their elastic limits to resist their deflection and return to their original static or relaxed condition. Upon such movement of the slidable carrier in either direction beyond its unstable centered position, the carrier is automatically securely held in a detented position in which a selected pair of the fixed contacts of the fixed contacts of the switch are electrically bridged by a slidable contact shoe as shown, for example, in FIGS. 3 and 5.

FIGS. 7 to 10, inclusive, illustrate a modified form of the present invention wherein the slidable contact carrier 14', instead of being provided with a pivoted toggle lever for actuating the same as in the construction hereinbefore described, is provided with an upstanding actuating knob 27' formed as an integral part of the carrier for directly effecting the requisite rectilinear shifting of the carrier for actuation of the slide switch. In this modified construction, the knob 27' projects upwardly through an elongated slot 41 formed in the top wall 42 of the switch housing 43 in registry with the elongated slot 31' formed in a detent member 28' similar in all material respects to the above described detent member 28, which detent member 28' is fixedly disposed in the switch housing between the top wall of the switch housing and the upper surface of the slidable contact carrier as in the previously toggle-actuated slide switch with the inner edges of its flexible struts 30'—30' respectively disposed inboard of the parallel side edges of the slot 41 formed in the top wall of the housing.

Preferably, the switch actuating knob 27', as best shown in FIG. 10, is provided with a bottom section 44 having a horizontal cross-sectional shape similar to that of the previously described toggle-actuated knob 27 which rides in the slot 31' of the detent member 28' and with an upper section 45 of suitably reduced cross-sectional size as to permit it to be freely projected upwardly through the top slot 41 of the switch housing.

As in the toggle-actuated slide switch construction of FIGS. 1 to 6, the direct knob-actuated slide switch of FIGS. 7 to 10 operates upon movement of the knob 27' in either direction beyond its dead center position within the slot 31' of the detent member 28' to snap the slidable contact carrier into one or the other of its opposite end-most positions wherein it is positively retained in operative condition by the interengaged and coacting tapered surfaces of the knob and the complementally tapered edges of the flexible struts of the detent member.

As has been pointed out above the present invention is applicable to slide-switches having any desired number of positions which may be assumed by the shiftable contact carrier, it being merely necessary to provide the detent plate with a slot having as many sets of camming edges as are required to snap the carrier knob into any selected one of its several operative positions. Exemplary of this is the slotted detent member 28'' of FIG. 11 wherein the inner edges of its flexible struts 30''—30'' are respectively formed to provide two sets of opposed points 32''—32'' which are selectively engageable by the opposite side ridges 35''—35'' of a carrier knob 27 rectilinearly shiftable in the slot of the detent member to outwardly flex the struts to generate the energy for snapping the carrier knob into a selected position to either side of the engaged set of the points 32''—32''. Thus, the modified detent plate 28'' enables the slidable contact carrier of a three-position slide switch to be selectively positioned with snap-action into a centered position as indicated by its full line position A shown in FIG. 11 or into either one of its two end-most dotted line positions B and C.

An important feature and advantage of the present invention is that while it effectively provides a snap-action movement to the contact-carrying slidable member of the switch, it does not impose any load upon such member as would tend to unduly increase the contact pressure between the fixed and movable contact elements of the switch, thereby minimizing premature wear of such elements and insuring easy and free snap action movement of the switch slide under control of its actuator, namely, the toggle lever as in the construction of FIGS. 1 to 6 or the direct actuating knob as in the construction of FIGS. 7 to 10.

It will be understood that the present invention is subject to various changes and modifications which may be made from time to time without departing from the general principles or real spirit thereof and that it is accordingly intended to claim the same broadly, as well as specifically, as indicated by the appended claims.

What is claimed as new and useful is:

1. A multi-position electrical slide switch comprising an enclosed switch assembly which includes a rectilinearly slidable insulated contact carrier mounting at least one elongated electrical contact movable therewith and a relatively fixed insulating support mounting a plurality of relatively fixed contact terminals spaced along the path of travel of each movable contact in underlying relation thereto, said movable contact being adapted to electrically bridge at least two adjacent ones of said spaced contact terminals upon shifting movement of said contact into one or another selected position, and a relatively stationary longitudinally slotted detent plate disposed above the top surface of said slidable contact carrier in a plane paralleling the path of travel of said movable contact, said contact carrier including an upstanding part having oppositely projecting V-shaped side walls which project upwardly through said slotted detent plate and said detent plate being provided with a pair of laterally spaced longitudinally extending flexible members which extend along the full length and define therebetween the slot of said detent plate, said flexible members being operatively engageable with opposite sides of said upwardly projecting part of said contact carrier and adapted to be temporarily sidewise oppositely biased by said part when said contact carrier is shifted out of any one of its said selected positions whereby said flexible members upon said temporary biasing thereof under sidewise pressure of said upwardly projecting part of said contact carrier establishes a releasable force for automatically effecting snap action movement of said slidable contact carrier into and retention thereof in said selected position.

2. A slide switch as defined in claim 1 wherein said detent plate is of a uniformly thin flat formation throughout and wherein said flexible members are formed as coplanar elements of said detent plate.

3. A slide switch as defined in claim 1 wherein the inner marginal portions of said flexible members are respectively provided with opposed sets of angularly related straight line edges which form therebetween oppositely disposed inwardly presenting juncture points located intermediate the opposite ends of said slot, which said points are respectively engageable by said V-shaped side walls of said upstanding part of said slidable contact carrier to outwardly flex said flexible members and thereby establish said releasable force for automatically shifting said carrier into its selected position.

4. A multi-position slide switch comprising a switch assembly which includes a rectilinearly slidable insulated contact carrier mounting at least one elongated electrical contact movable therewith and a relatively fixed insulated support mounting a plurality of relatively fixed contact terminals spaced along the path of travel of each movable contact in underlying relation thereto, said movable contact being adapted to electrically bridge at least two adjacent ones of said spaced contact terminals upon shifting movement of said movable contact into one or another selected position, said contact carrier having an upstanding knob part the opposite sides of which each have angularly related surfaces to form therebetween an outwardly presenting V-shaped projection, and detent means including a pair of elongated flexible beams operative at opposite sides of said contact carrier knob part to be temporarily flexed outwardly from said opposite sides of the carrier, the inner edges of said beams each having angularly related straight line portions defining therebetween points which respectively operatively engage the projections of said knob part of the contact carrier when the latter is rectilinearly shifted along its said path of travel to thereby establish a releasable force under pressure of said carrier knob part as the latter moves into a position centered between two adjacent longitudinally spaced positions in each of which said slidable contact bridges a pair of said contact terminals, said means being automatically operative to release said force and effect snap-action movement of said contact carrier into and positively hold it stationarily fixed in one or the other of its said contact bridging positions upon continued movement thereof beyond its said centered position.

5. In a slide switch as defined in claim 4 wherein said angularly related inner edges of said flexible beams are oppositely disposed and function as cams to shift the contact carrier with snap action into one or other of said fixed positions.

6. In a multi-position slide switch having a rectilinearly slidable insulated contact mounting at least one elongated electrical contact movable therewith, and a relatively fixed insulated support mounting a plurality of relatively fixed contact terminals spaced along the path of travel of each movable contact in underlying relation thereto, said movable contact being adapted to electrically bridge at least two adjacent ones of said spaced contact terminals upon shifting movement of said movable contact into a selected position, the improvement which comprises:

a relatively thin flat detent plate fixedly disposed flatwise in a plane closely adjoining and paralleling the top surface of said rectilinearly slidable contact carrier, said detent plate having a pair of longitudinally extending laterally spaced flexible beams coplanarly disposed in the flat plane of said plate which respectively define the opposite longitudinally extending sides of an elongated slot in said plate, a knob on said contact carrier projecting upwardly through and shiftable rectilinearly in the slot in said detent plate, and coacting sharply defined ridges respectively formed as the apices of a pair of substantially identical angularly related straight line portions of the corresponding sides of said slot and of said knob to effect simultaneous temporary outward flexure of said beams as said coacting ridges are brought into registry with one another upon movement of the knob along said slot in said detent plate and thereby establish a releasable force for camming the slidable contact into a selected one or the other of two adjacent contact-bridging positions in which the contact carrier is positively held.

7. A slide switch as defined in claim 6 wherein said flexible beams of said detent plate are formed of a material having a coefficient of elasticity which enables the same to regain their initial unflexed static condition when the deforming force or pressure causing them to be temporarily flexed is released.

8. A slide switch as defined in claim 6 wherein said switch assembly includes a housing for enclosing the same having a top wall disposed in closely overlying parallel relation to said detent plate.

9. A slide switch as defined in claim 8 wherein said housing top wall is provided with depending side walls which embrace therebetween said slidable contact carrier and serve to guide the latter along a defined path of travel.

10. A slide switch as defined in claim 9 wherein said housing top wall is provided with an upwardly projecting fitting in which is journalled a toggle-actuating means for said slidable contact carrier, said toggle-actuating means including a lever having its lower end seated in a recess formed in the top of said knob.

11. A slide switch as defined in claim 9 wherein said top wall is slotted for projection upwardly therethrough of said knob whereby to render the latter accessible for manual rectilinear movement thereof.

* * * * *